US009863193B2

(12) United States Patent
Buchanan

(10) Patent No.: US 9,863,193 B2
(45) Date of Patent: Jan. 9, 2018

(54) HYDRAULICALLY POWERED TROUGH EXTENSION FOR A PIPE HANDLING, PIPE LAYDOWN AND PIPE PICKUP MACHINE

(71) Applicant: Max Buchanan, Denton, TX (US)

(72) Inventor: Max Buchanan, Denton, TX (US)

( * ) Notice: Subject to any disclaimer, the term of this patent is extended or adjusted under 35 U.S.C. 154(b) by 40 days.

(21) Appl. No.: 14/730,773

(22) Filed: Jun. 4, 2015

(65) Prior Publication Data

US 2016/0356103 A1 Dec. 8, 2016

(51) Int. Cl.
*E21B 19/00* (2006.01)
*E21B 19/15* (2006.01)

(52) U.S. Cl.
CPC ..... *E21B 19/15* (2013.01)

(58) Field of Classification Search
CPC ..... E21B 19/14; E21B 19/15; E21B 19/155; E21B 19/18; E21B 19/20
USPC ..... 414/22.51–22.71
See application file for complete search history.

(56) References Cited

U.S. PATENT DOCUMENTS 3,139,173 A * 6/1964 Greaves ..... A01D 87/122 198/632
3,937,514 A * 2/1976 Langowski ..... E21B 19/14 294/106
4,235,566 A * 11/1980 Beeman ..... E21B 19/155 175/85
4,366,606 A * 1/1983 Willis ..... E21B 19/06 269/218
7,404,697 B2 * 7/2008 Thompson ..... E21B 19/155 414/22.58
2002/0178655 A1 * 12/2002 Pedemonte ..... E05F 15/63 49/339
2005/0269835 A1 * 12/2005 Nelson ..... B62D 33/0276 296/186.2
2010/0068006 A1 * 3/2010 Littlewood ..... E21B 19/15 414/22.61
2011/0070054 A1 * 3/2011 Crossley ..... E21B 19/14 414/22.61

* cited by examiner

*Primary Examiner* — Anna M Momper
*Assistant Examiner* — Lynn E Schwenning
(74) *Attorney, Agent, or Firm* — David G Moore

(57) ABSTRACT

A hydraulically powered trough extension attached to a pipe handling, pipe pickup and pipe laydown tool can be extended hydraulically to facilitate transport of pipe to/from a drill rig. The hydraulically powered trough extension is semipermanently attached to the trough of the pipe handling, pipe pickup and pipe laydown machine to eliminate the need for special equipment to attach a trough extension to the trough. A specially designed hinge enables the hydraulically powered trough extension to be folded so as to lay flat on the trough of the pipe handling, pipe laydown and pipe pickup machine. When the hydraulically powered trough extension is fully extended the hinge mechanism does not obstruct the movement of pipe on or off the pipe pickup and pipe laydown machine. This feature enables the hydraulically powered trough extension to be easily and safely extended for moving pipe to/from the drill platform and when folded for easy transport to another work site without the need for extra equipment.

1 Claim, 5 Drawing Sheets

HYDRAULICALLY POWERED TROUGH EXTENSION FOR A PIPE HANDLING, PIPE LAYDOWN AND PIPE PICKUP MACHINE

CROSS-REFERENCE TO RELATED APPLICATIONS

This utility patent application seeks priority to and benefit of U.S. Provisional patent application Ser. No. 06/997,850 filed on Jun. 11, 2014

STATEMENT REGARDING FEDERALLY SPONSORED RESEARCH OR DEVELOPMENT

No part of the invention disclosed herein was the subject of federally sponsored research or development.

THE NAMES OF THE PARTIES TO A JOINT RESEARCH AGREEMENT

Not applicable

REFERENCE TO A SEQUENCE LISTING

Not applicable

BACKGROUND

Field

The field of the invention is a tool to economically and safely raise and lower pipe to a drilling platform by use of a hydraulically powered trough extension.

Description of the Prior Art

Extraction of oil, natural gas, water and other valuable materials from deep in the earth requires drilling a hole to the reservoir holding the valuable materials and inserting pipe, also called tubulars, of various lengths and circumferences into the hole. The pipe are connected together to form a long tube through which the valuable materials are extracted and through which drilling chemicals are injected into the reservoir to stabilize the hole and assist in extracting the valuable materials. Some of the drilled holes may require thousands of feet of pipe in order to reach the reservoir of valuable materials. The pipe must be delivered to the drill site and raised onto the drilling platform for connection to another section of pipe prior to insertion into the hole. The economic feasibility of drilling for oil, natural gas, water and other valuable materials demands that the pipe be quickly, safely and efficiently lifted onto the drilling platform. When drilling is completed it is necessary to remove the pipe from the drill hole. In that circumstance the process is reversed. The pipe is removed from the hole and disengaged from the next section of pipe on the drilling platform. The disconnected pipe must then be lowered from the drilling platform quickly, efficiently and safely for another use.

A pipe handling, pipe lay down and pipe pickup tool is moved to the drill site for moving pipe to the drill platform. The main components of the pipe handling, pipe lay down and pipe pickup machine are: 1) a trailer or other mobile platform, 2) a trough which extends down the long axis of the trailer, 3) a boom, 4) a sled, 5) pipe indexers, 6) pipe kickers, 7) a power supply and 8) an extension. The trailer is equipped with at least six outriggers (3/side) to stabilize the device during use. The trough runs down the long axis of the trailer and is the location where the pipe is placed for lifting to the drilling platform. The trough is also the location where pipe is received when removed from the drilling platform.

A sled is attached to the end of the trough proximal to the power supply and distal from the extension. The sled moves through the trough by two parallel heavy duty chains which run the length of the trough. These chains can be tensioned by the chain drive box and tensioning devices located on each chain and attached to the sled. The sled pushes the pipe up the elevated trough for loading onto the drill platform. When drill pipe is removed from the hole, the sled allows the pipe to slide down the trough in a safe controlled manner. To cushion the pipe, the sled is equipped with a shock absorber. Pipe is moved from the storage area to the trough by pipe indexers located on the side of the trailer. A set of three pipe indexers is positioned on each side of the trailer to permit loading of the trough with pipe from either side of the trailer. Pipe may be moved from the storage area and placed on the pipe indexers either mechanically or manually. Pipe is unloaded from the trough by a set of three pipe kickers which are configured to push the pipe out of the trough on either side of the trailer at the direction of the operator.

An extension is attached to the trough to extend the height at which pipe can be moved. In prior art versions, the extension is attached to the end of the trough by bolts or other threaded fasteners With addition of the extension, pipe can be lifted to or removed from a drill platform located 4 feet to 30 feet or more in height. Prior art trough extensions are mechanically or manually raised to the trough and are bolted into place when needed. This process requires additional equipment such as a fork lift or a team of workers to physically raise the extension into position where it is manually bolted in place. This process creates a safety risk for the workers. What is needed in the art is a trough extension which is securely fastened to the trough and which can be extended/retracted from/to the trough hydraulically.

BRIEF DESCRIPTION OF THE INVENTION

The invention disclosed herein is a trough extension which is securely fastened to the trough and can be extended/retracted from/to the trough hydraulically. The extension disclosed herein is operated hydraulically and does not place workers at risk of injury. The hydraulically powered trough extension is attached to the trough by a plurality of substantially L shaped hinge arms which enable the hydraulically powered trough extension to be folded flat onto the trough and extended when needed. Because the hydraulically powered trough extension is securely attached to the trough, additional equipment or manpower is not required to attach the trough extension to the trough. When the trough extension is extended the extension hinge lies below the surface of the deck so as to not obstruct the movement of pipe on or off the trough.

BRIEF DESCRIPTION OF THE DRAWING/FIGURES

A better understanding of the invention disclosed herein may be had by examination of the following drawing/figures:

FIG. 1*a* is a side view of the pipe handling machine with the trough extension folded in.

FIG. 1*b* is a side view of the pipe handling machine with the trough extension extended.

FIG. 1*c* is a side view of the pipe handling machine with the trough partially elevated.

FIG. 1*d* is a side view of the pipe handling machine with the trough further elevated.

DETAILED DESCRIPTION OF THE INVENTION

Figure 1A:
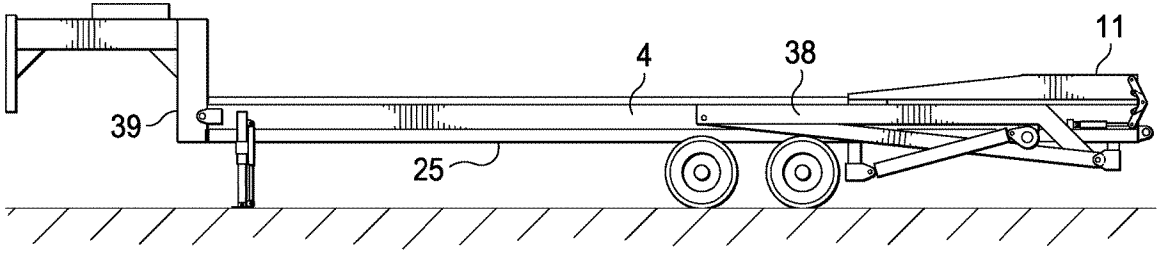
Figure 1B:
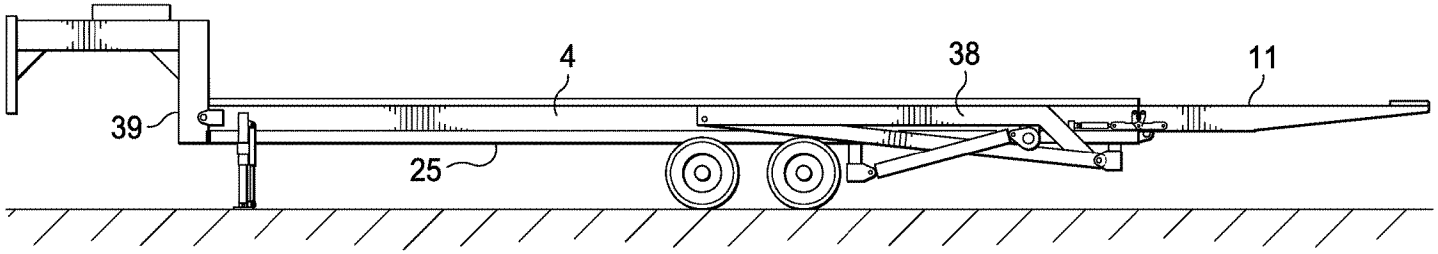

The invention disclosed herein is a hydraulically powered trough extension which because of a unique hinge mechanism may lie flat on the trough when folded and be extended hydraulically for transfer of pipe to/from a drill platform by a pipe handling machine. The hydraulically powered trough extension eliminates additional equipment or manpower to attach a trough extension to a pipe handling machine, thereby lowering costs and decreasing the risk of injury to workers. As shown in FIG. 1*a* the hydraulically powered trough extension 11 is folded back onto the trough 4 positioned on the frame 25 which in this figure is affixed to a flat bed trailer 39. The hydraulically powered trough extension 11 is fully extended as shown in FIG. 1*b*. The extension of the hydraulically powered trough extension 11 permits pipe to be loaded into the trough 4 and moved to the drill platform.

Figure 1C:
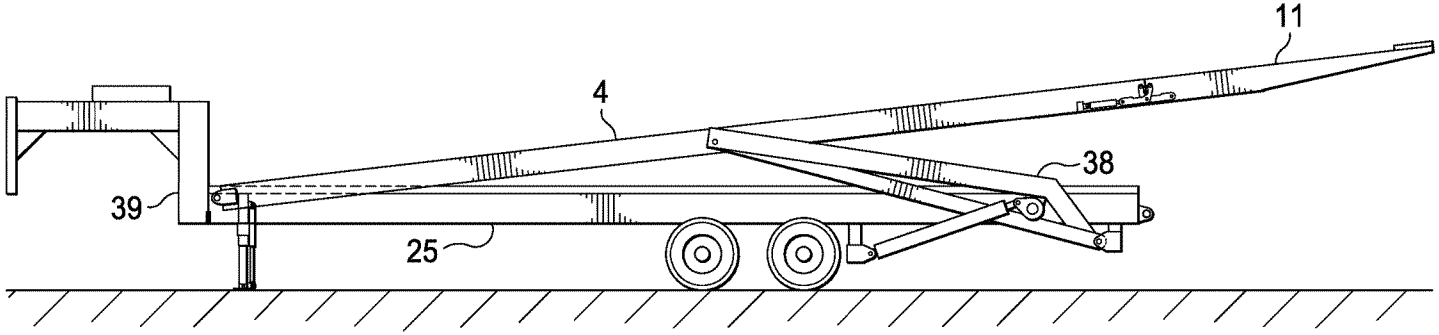
Figure 1D:
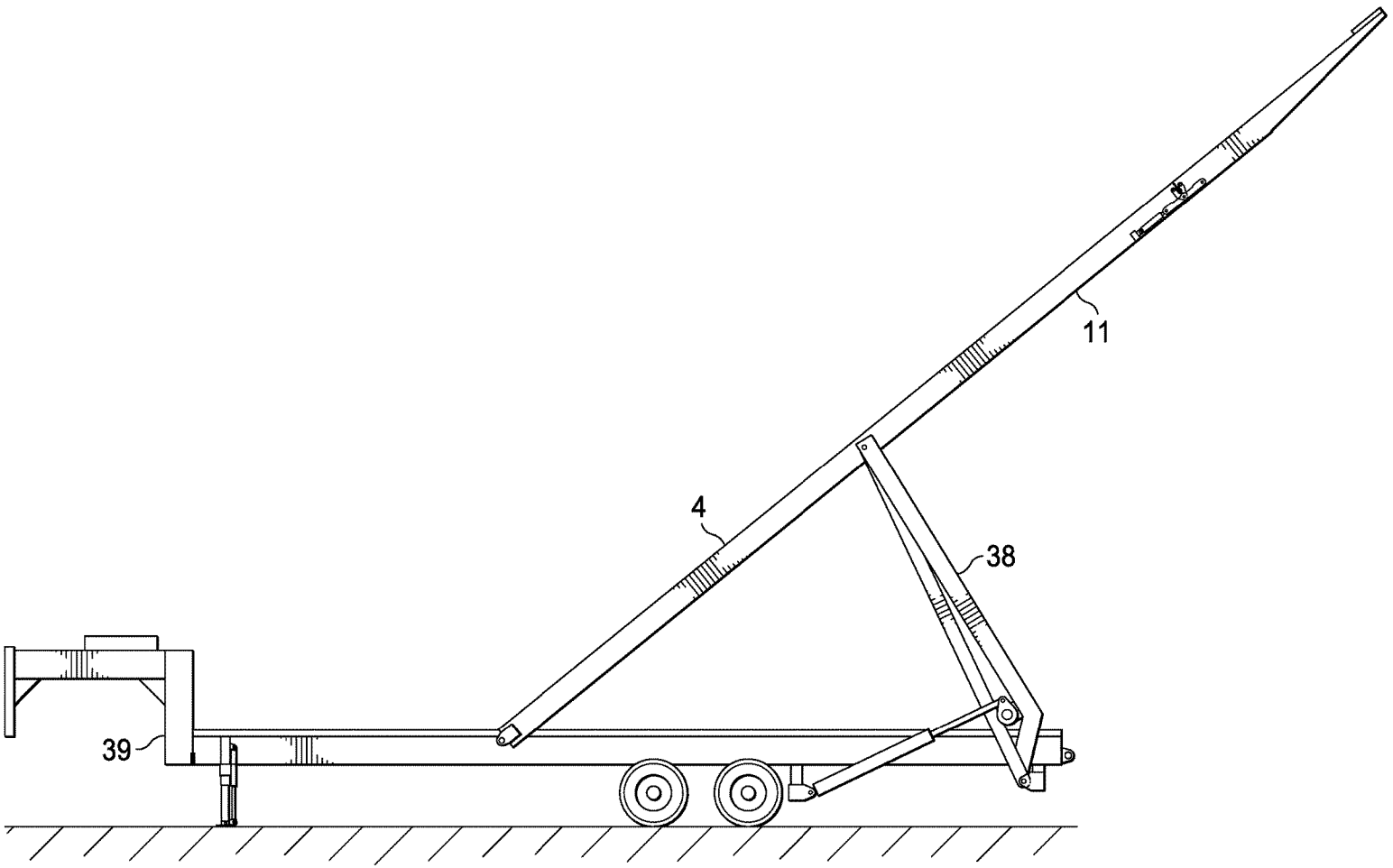

The trough 4 with the hydraulically powered trough extension 11 is elevated above the frame 25 by a trough hoist mechanism 38 attached to the frame 25 as shown in FIGS. 1*c* and 1 *d*. By this combination of an elevatable trough 4 with a hydraulically powered trough extension 11, pipe can be safely and conveniently moved to/from a drill platform.

Figure 2:
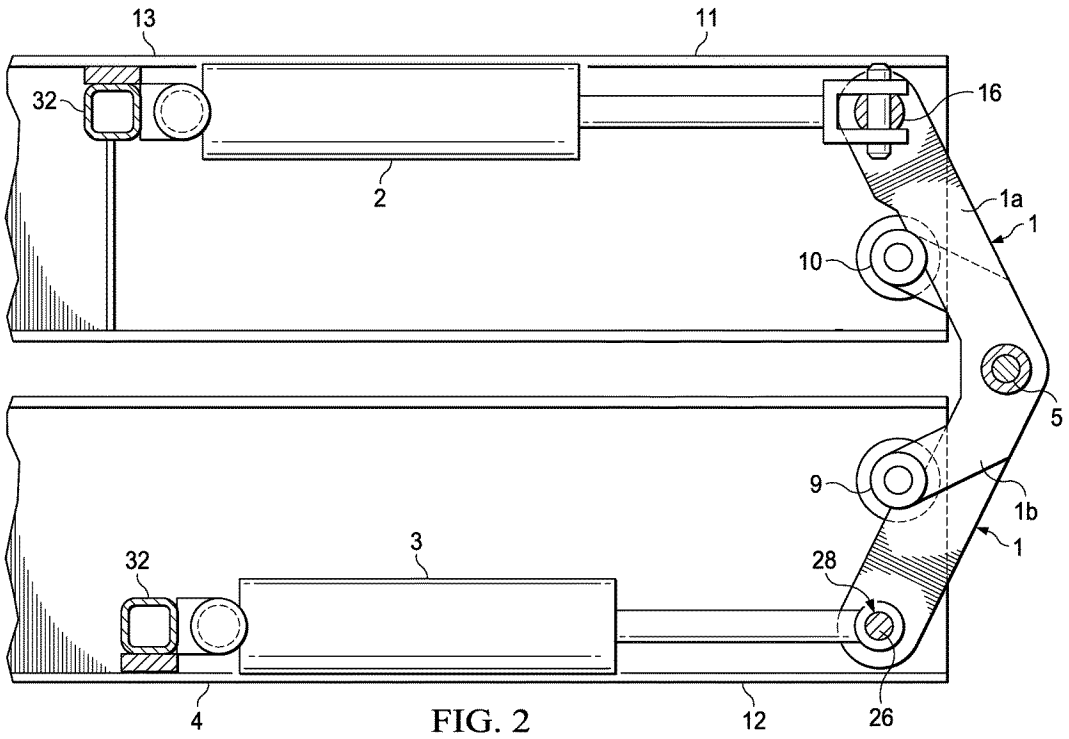
FIG. 2 is a side view of the hydraulically powered extension trough hinge with the hydraulically powered extension trough folded onto the trough.
Figure 3:
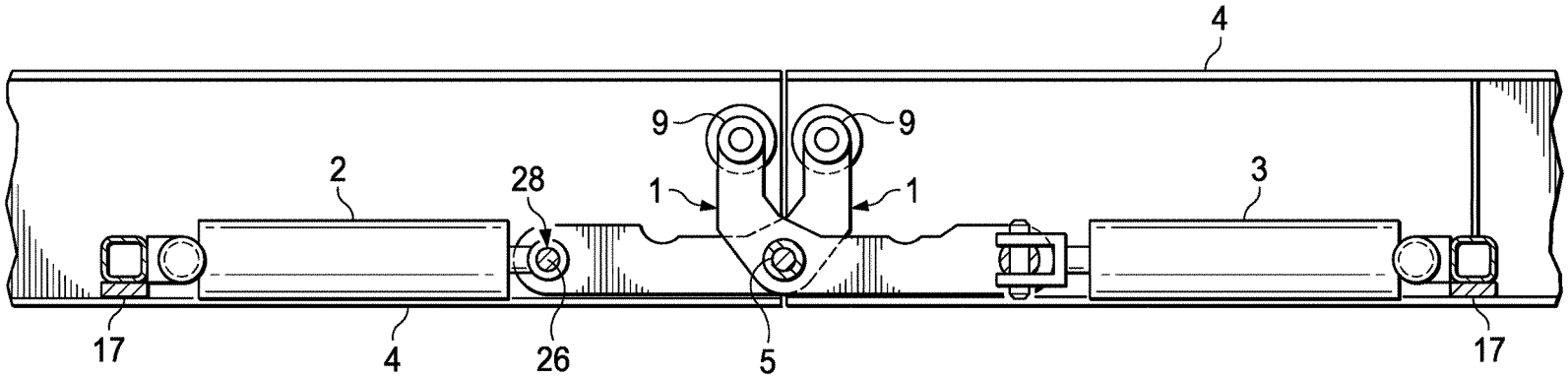
FIG. 3 is a side view of the hydraulically powered extension trough fully extended.
Figure 4:
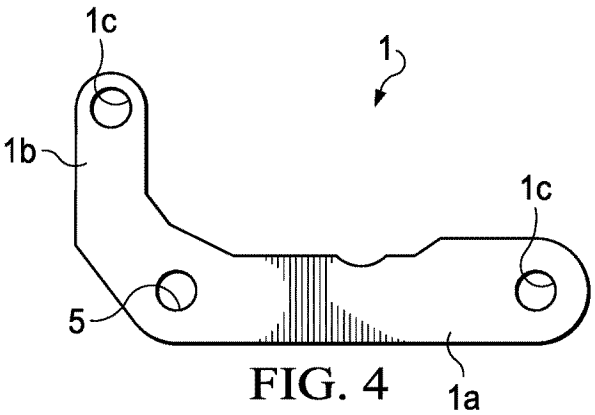
FIG. 4 is a side view of a hinge arm.

As shown in FIG. 2, the hydraulically powered trough extension 11 is folded onto the trough 4. The hydraulically powered trough extension 11 is connected to the trough 4 by a plurality of hinge arms 1. As shown in FIG. 4 the hinge arm 1 is substantially L-shaped with a short arm 1*b* and a long arm 1*a*. In another embodiment the hinge arms may be designed to be substantially crescent shaped. In other embodiments the hinge arms may be designed and constructed in any shape that does not interfere or obstruct the other components of the hinge. The hinge arm 1 is configured with attachment sites 1*c* located at the end of both the short arm 1*b* and the long arm 1*a* so that the hinge arms 1 can be securely fastened to both the hydraulically powered trough extension 11 and to the trough 4. The attachment site 1*c* also acts as a pivot point when the hydraulically powered trough extension 11 is retracted or extended. A pivot pin 5 connects the hinge arm 1 to the hydraulically powered trough extension 11. The hydraulically powered trough extension 11 pivots about the trough 4 at the pivot pin 5 and 1*c* when the hydraulically powered trough extension 11 is extended or folded onto the trough 4. As shown in FIGS. 2 and 3 the long arm 1*a* of a plurality of hinge arms 1 is connected to a track roller 16 positioned on the hydraulically powered trough extension 11. The short arm 1*b* of the hinge arm 1 connected is attached to a trough hinge pin 9 positioned on the trough 4. The extension hydraulic cylinder 2 is attached at midpoint 17 of the extension roller cross shaft 15 of the hydraulically powered hydraulic extension 11 (see FIG. 5). The opposite end of the extension hydraulic cylinder 2 is attached to a rear cylinder mount 32 securely attached to the frame 13 of the hydraulically powered trough extension 11. The hydraulically powered trough extension 11 is further connected to the trough 4 through a short arm 1*b* of a plurality of hinge arms 1 at the extension hinge pin 10. The long arm 1*a* of the plurality of hinge arms 1 is further connected to the trough 4 at the hinge slide shaft 28. The trough hydraulic cylinder 3 is attached to another rear cylinder mount 32 which is securely attached to the frame of the trough 4. The opposite end of the trough hydraulic cylinder 3 is attached to a slide cylinder mount 27 (see FIG. 5). When, as shown in FIG. 2 the hydraulically powered trough extension 11 is folded onto the trough 4 the hydraulic cylinders 2 and 3 on both the hydraulically powered extension 11 and the trough 4 are fully extended. In another embodiment a single hydraulic cylinder may be used to extend the trough extension by detaching the hydraulic cylinder from one component of the hinge and reattaching the hydraulic cylinder to another component of the hinge as the extension/retraction process proceeds.

When the hydraulically powered trough extension 11 is fully extended as shown in FIG. 3, the extension hydraulic cylinders 2 and trough hydraulic cylinder 3 positioned on the hydraulically powered trough extension 11 and the trough 4 are fully compressed. This compression of the hydraulic cylinders 2 and 3 cause the plurality of hinge arms 1 to pull the hydraulic powered trough extension 11 to the fully extended configuration.

Figure 5:
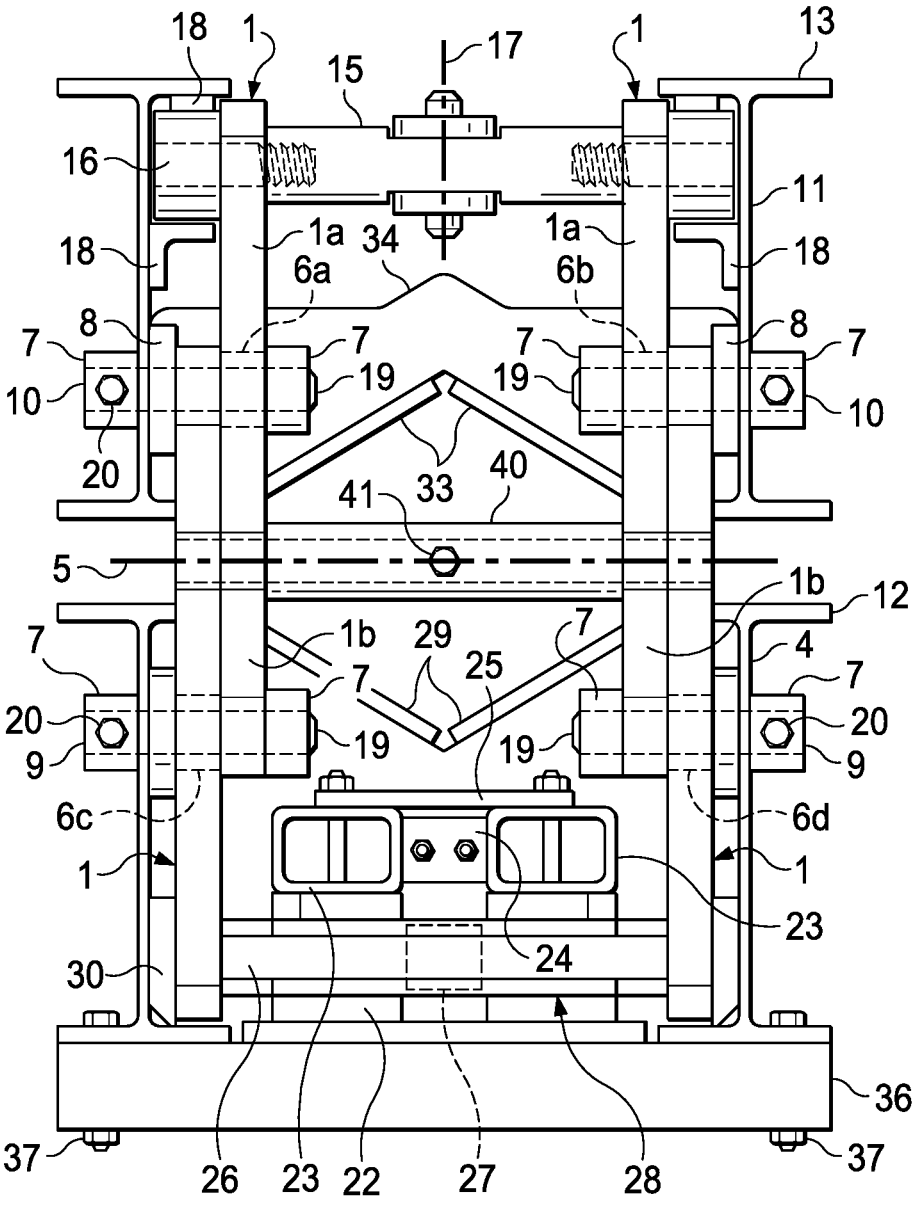
FIG. 5 is an end view of the hinge connecting the hydraulically powered trough extension to the trough.

The hinge assembly which connects the hydraulically powered trough extension 11 to the trough 4 is shown in FIG. 5 in which the hydraulically powered trough extension 11 is shown folded onto the trough 4. A plurality of hinge arms 1 through the long arm 1*a* of the hinge arms 1 are connected to the frame 13 of the hydraulically powered trough extension 11 by an extension roller cross shaft 15 which extends from the long arm 1*a* of a plurality of hinge arms 1 located on one side of the hydraulically powered trough extension 11 to the other side of the hydraulically powered trough extension 11 where an identical set of hinge arms 1 connected by the long arm 1*a* are connected to the frame 13 of the hydraulically powered trough extension 11. Both sets of hinge arms 1 are connected by the extension roller cross shaft 15 The extension roller cross shaft 15 is connected to the track roller 16 which is held in place by track roller guides 18 located on either side of the track roller 16. The extension hydraulic cylinder 2 is attached to the extension roller cross shaft 15 midway between the hinge arms 1 located on either side of the hydraulically powered hinge extension 11 at reference number 17. The short arms 1*b* of the plurality of hinge arms 1 are attached to the trough frame 12 by trough hinge pins 9. The trough hinge pins 9 are held in place by a pair of pin bosses 7 located on either side of the trough hinge pin 9.

Also as shown in FIG. 4, a plurality of hinge arms 1 located externally to the first two sets of hinge arms 1 described in paragraph 18 are connected to the hydraulically powered trough extension 11 by the short arm 1*b* of the hinge arms 1 by an extension hinge pin 10. Spacers 8 constructed from plastic separate the external hinge arms 1 from the extension frame 13. The long arms 1*a* of the external hinge arms 1 are attached to the trough 4 by a trough hinge slide 6. The external hinge arms 1 are separated from the trough frame 12 by spacers 30 constructed from plastic. Both the extension hinge pin 10 and the trough hinge pin 9 are secured by hinge pin retention bolts 20. The left and right external long arms 1*a* of the external hinge arms 1 are connected to the hinge slide shaft 28 located within the hinge slide 26. At the midpoint 27 of the hinge slide shaft 28, the trough hydraulic cylinder 3 is attached. The hinge slide shaft 28 is held in position by a plurality of spacers 30 which permit the hinge slide shaft 28 to move smoothly when the trough hydraulic cylinder 3 is activated. A hinge upper bearing mount 23 is attached to the trough frame 12 and separated by plastic bearings 22 to properly align the hinge slide 26. The extension vee 33 of the hydraulically powered trough extension 11 is nonremovable and cradles the pipe when the hydraulically powered trough extension 11 is fully extended. Attached to the trough 4 are removable Vee trough panels 29 which allow access to the hinge assembly components. The trough 4 and hydraulically powered trough extension 11 are structurally supported by a plurality of frame cross members 34 which in one embodiment are welded to the frame 13 of the hydraulically powered trough extension 11. Likewise, the trough 4 is structurally supported by a plurality of frame cross members 34 which are welded to the frame 12 of the trough 4. Structural support is also provided to the trough 4 and hinge slide 26 by a hinge bottom plate 36 which is affixed to the trough frame 12 by a plurality of hinge bottom plate retention bolts 37. When the hydraulically powered trough extension 11 is extended by the extension hydraulic cylinder 2 and the trough hydraulic cylinder 3 the hydraulically powered trough extension 11 rotates around the hinge pivot pins 5, 9 and 10 until the hydraulically powered trough extension 11 is fully extended. The plurality of hinge arms 1 are further aligned by pivot pin 5 and by sleeves 40 which are connected by a fastener 41. Lubrication of the extension hinge pin 10 and the trough extension pin 9 is enabled by grease ports 19. The hinge upper bearing mount 23 may be lubricated as needed by grease ports 24.

The pipe handling tool equipped with the hydraulically powered trough extension disclosed herein can be constructed and configured for many applications and is not limited to underground drilling operations. The pipe handling tool with the hydraulically powered trough extension can also be configured for lifting and removing pipe at offshore drilling rigs. The pipe handling tool with the hydraulically powered trough extension can be used for lifting or lowering elongated cylindrical poles for construction of utilities, buildings and other structures.

I claim:

1. A hydraulically powered trough extension for a pipe handling, pipe laydown and pipe pickup machine comprising:

a trough extension;

a trough attached to a pipe handling, pipe laydown and pipe handling pickup machine;

a first hydraulic cylinder attached to said trough extension;

a second hydraulic cylinder attached to said trough;

a first set of substantially L shaped hinge arms each with a short arm and a long arm with said short arm pivotally connected to said trough extension and said long arm connected to said trough;

a second set of substantially L shaped hinge arms each with a short arm and a long arm with said short arm pivotally connected to said trough extension and said long arm connected to said trough positioned on the opposite side from said first set of substantially L shaped hinge arms of said hydraulically powered trough extension and said trough;

a third set of substantially L shaped hinge arms each with a short arm and a long arm with said long arm pivotally connected to said trough extension and said short arm connected to said trough;

a fourth set of substantially L shaped hinge arms each with a short arm and a long arm with said long arm pivotally connected to said trough extension and said short arm connected to said trough and positioned on the opposite side from said third set of substantially L shaped hinge arms of said hydraulically powered trough extension and said trough;

an extension roller cross shaft connecting said third set and said fourth set of substantially shaped L shaped hinge arms;

a hinge slide shaft connecting said first set and said second set of substantially L shaped hinge arms;

a pivot pin separately connecting each said first set and said second set of substantially L shaped hinge arms to said trough;

whereby, the activation of said first hydraulic cylinder attached to said trough extension and activation of said second hydraulic cylinder attached to said trough causes the said first, second, third and fourth substantially L shaped hinge arms attached to said trough extension and said trough to pivot about a pivot point causing said trough extension to fully extend or retract.

* * * * *